United States Patent [19]

Matsuo et al.

[11] 4,304,650

[45] Dec. 8, 1981

[54] STRIPPING APPARATUS FOR USE IN CATHODE BASE PLATE FOR ELECTROLYTIC REFINING

[75] Inventors: Hiroaki Matsuo, Oaza-Higashimachi; Satoshi Arita; Kiyomi Touge, both of Gifu, all of Japan

[73] Assignee: Mitsui Mining & Smelting Co., Ltd., Tokyo, Japan

[21] Appl. No.: 199,407

[22] Filed: Oct. 22, 1980

[30] Foreign Application Priority Data

Oct. 30, 1979 [JP] Japan ..... 54-140292

[51] Int. Cl.[3] ..... C25D 17/00

[52] U.S. Cl. ..... 204/194; 204/281

[58] Field of Search ..... 204/12, 194, 281

[56] References Cited

U.S. PATENT DOCUMENTS 3,625,806 12/1971 Wennberg ..... 204/12

3,847,779 11/1974 Sekine ..... 204/281

3,953,312 4/1976 Kikkawa ..... 204/12

*Primary Examiner*—T. M. Tufariello

*Attorney, Agent, or Firm*—Blanchard, Flynn, Thiel, Boutell & Tanis

[57] ABSTRACT

A stripping apparatus for use with a cathode base plate for electrolytic refining comprises a supporting means for holding a cathode plate in an upright position; a pair of stripping means having sharpened wedges mounted on their heads and including elastic means for actuating said stripping means so that the wedges may be spaced apart or draw toward each other, said wedges being arranged to move along the cathode base plate from its upper part to its lower part; working means for moving said stripping means; and controlling means for causing the stripping means to be drawn toward each other so that the wedges which are initially spaced from the surfaces of the base plate owing to the spacing movement of the stripping means engage the surface of the base plate and thereafter the stripping means are moved apart so that said wedges may be kept spaced from the surfaces of the base plate.

8 Claims, 14 Drawing Figures

STRIPPING APPARATUS FOR USE IN CATHODE BASE PLATE FOR ELECTROLYTIC REFINING

BACKGROUND OF THE INVENTION

This invention relates to an apparatus for stripping a metal plate from a cathode base plate used for electrolytic refining, said metal plate being electrodeposited on said base plate.

Hitherto known apparatuses of this sort can be roughly classified into the following two types, namely, (1) an apparatus in which a pair of scrapers with wedges having a horizontal length substantially equivalent to the width of a cathode base plate (which will be called base plate hereinafter) is inserted at an upper corner at one side of an electrodeposited metal plate (which will be called metal plate hereinafter) between the base plate and the metal plate, first moving it horizontally to the other side, and then moving the scrapers vertically relative to the base plate to thereby peel off the metal plate from the base plate and (2) an apparatus in which a scraper is inserted between a base plate and a metal plate on one side of the metal plate, said scraper comprising a wedge which has a longitudinal length substantially equivalent to that of the metal plate and a part of the uppermost portion of which is edged, and moving the scraper as it stands horizontally to thereby peel off the metal plate from the base plate.

However, both apparatuses are defective in the following points: that because the scraper is designed to move horizontally over a very long distance, when a cylinder is employed as its working member, its piston rod inevitably must be long; that in order to avoid such trouble there must be employed a short stroke cylinder and accordingly there must be installed a stroke widening mechanism comprising rack, pinion and the like for the purpose of widening the short stroke of the piston rod; and further that because there is a necessity of installing a guide mechanism, such as a guide roller, slider or the like, in order to permit the scraper to move accurately covering a very long distance, it is unavoidable that both apparatuses on the whole should come to have an extremely complicated structure. Referring to the former, furthermore, it involves additional drawbacks in that because it has a need of employing a mechanism for vertical movement, the apparatus unavoidably becomes more complicated, difficult to operate and maintain, extremely high-priced and so forth.

Referring to the latter, it was still further defective in that, due to the fact that the wedge is pressed against the base plate covering the whole length of the stroke, the base plate is liable to extensive damage and abrasion.

SUMMARY OF THE INVENTION

It is an object of this invention to provide a compact and economic stripping apparatus capable of eliminating a defect of conventional treating apparatuses, namely, the necessity of utilizing a large-scale and complicated apparatus for moving the stripping means.

According to this invention, the foresaid object can be achieved by providing a stripping apparatus comprising a supporting means installed for holding a cathode plate in an upright position; a pair of stripping means having sharpened wedges on their heads and including elastic means for actuating said stripping means so that the wedges may be spaced apart from or drawn toward each other, the latter being adapted for moving along a circular arc-like locus from one corner to the other corner of the base plate; means for swinging said stripping means; and controlling means for allowing the stripping means to draw near to each other so that the wedges initially spaced from the surface of the base plate owing to the spacing movement of the stripping means may engage the surface of the base plate, and thereafter spacing apart the stripping means so that said wedges may be moved away from the surface of the base plate. In other words, according to the stripping apparatus of this invention, the wedges are designed to move along the circular arc-like locus but not to make rectilinear horizontal and vertical movements. Due to this, the moving stroke of the working means may be shortened and accordingly the working means per se may be designed into an extremely simiplified mechanism. In addition thereto, the present stripping apparatus can dispense with the necessity of installing various kinds of guide means for securing the movement of means for connecting the working means with the stripping means and further permits use of a simple-structured cam as the controlling means. Therefore, the apparatus as the whole can be made with a simplified structure and can be produced cheaply.

Another object of this invention is to provide a stripping apparatus which will inflict little damage on the base plate.

In more detail, according to this stripping apparatus, the wedges, when being influenced by or outside of the action of the controlling means, are mounted on elastic means having a spring force sufficient to engage the base plate and therefore at the initial stage of stripping the metal plate, the stripping operation is carried out by wedges moving while engaging the base plate by the action of said spring force or the force of the controlling means, but since the wedges are thereafter spaced from each other by the force of the controlling means or the spring force of the elastic means, the stripping operation is carried out by the wedges which have no engagement with the base plate. This can relatively shorten the time during which the wedges slide while engaging the base plate, whereby the damage on the base plate caused by wedges is reduced and the maintenance frequency is also reduced, which leads to prolonged life of the base plate.

DETAILED DESCRIPTION OF THE INVENTION

Figure 1:
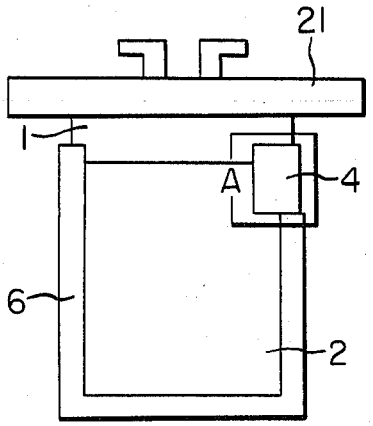
FIG. 1 is a general elevational view of a base plate suitable for stripping by the stripping apparatus according to this invention.
Figure 2:
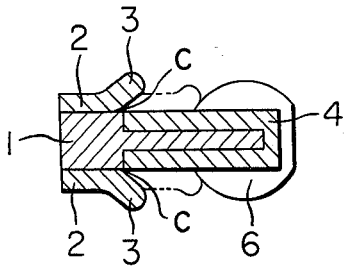
FIG. 2 is an enlarged sectional view of the portion A of one embodiment of the base plate illustrated in FIG. 1.
Figure 3:
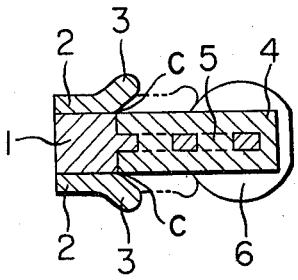
FIG. 3 is an enlarged sectional view of the portion A of another embodiment of the base plate illustrated in FIG. 1.

FIGS. 1 to 3 each illustrate a base plate 1 suitable for being stripped by the stripping apparatus according to this invention, wherein FIG. 1 is a general elevational view of said base plate and FIGS. 2 and 3 are sectional views illustrating embodiments different in respect of the portion A of FIG. 1.

In FIGS. 1 to 3, reference numeral 1 denotes a base plate which is so constructed that an insulating material 4 is mounted thereon at the portion of said base plate which a stripping means (not shown) can engage namely, the portion A above the right side edge of the base plate 1 in FIG. 1, wherein the thin portion of said side edge is inserted between the legs thereof of said insulating material. The insulating material 4 comprises a plastic such as epoxy or polyester resin, and the like or rubber and each leg thereof has a thickness of about 2 mm at the portion adapted for receiving the thin portion of the side edge therebetween. In the case of the base plate illustrated in FIG. 3, through holes 5 are perforated in the thin portion of the base plate 1 and the insulating material 4 mounted on both sides of the base plate 1 is partially embedded in said through holes 5, whereby both sides of the insulating material are connected together so as to have a total thickness of about 6 mm which is substantially identical to that of the base plate 1.

In this context, reference numeral 6 denotes a conventional frame made of insulating material for separating the metal plate formed on both sides of the base plate 1, and reference numeral 21 denotes a beam.

The peripheral edge portion 3 of the metal plate 2 formed by using the base plate 1 as aforesaid is at an obtuse angle relative to the base plate 1, whereby a wedge-like gap C suitable for inserting the stripping means is formed in the border line therebetween.

First embodiment:

In FIGS. 4 to 9, a set of about ten base plates 1 is placed by means of a hoist or the like and is suspended from a beam 21 at regular intervals on frame 27.

A respective stripping apparatus 15 is provided at the side position opposite to each base plate 1, said apparatus 15 including a pair of scrapers 8 and 8', and a cam plate 7 for causing scrapers 8 and 8' to be spaced from each other. Explanation will be made as to the structure and operation of scrapers 8 and 8' hereinafter.

Scrapers 8 and 8' are pivotally supported at their lower ends by means of a pin 14' on a bracket 9 secured to the frame 27. Wedges 10 and 10' are mounted on the upper ends of said scrapers and are adapted to be positioned against the insulating material 4 of the base plate 1. The scrapers 8 and 8' are formed as a plate spring and are urged toward mutually adjacent positions, and therefore are so designed that wedges 10 and 10' are adapted to engage the opposite surfaces of insulating material 4 when no force is applied from the outside. The cylinder 19 is pivotally supported by means of a pin 12 on a bracket 11 mounted on the frame 27, and the head 13 of a piston rod is pivotally supported in the base plate of scrapers 8 and 8' by means of a pin 14. The cam plate 7 is attached at its base end to the frame 27, is located midway between scrapers 8 and 8' above the cylinder 19 and includes fore and rear raised portions 16, 16' and 17, 17' and middle depressed portions 18, 18'.

The stripping operation using the aforesaid apparatus will be explained hereinafter mainly with reference to FIGS. 6 to 9. The positions where scrapers 8 and 8' are located at the positions designated by the symbols VI—IX in FIG. 4 are represented successively in FIGS. 6 to 9, wherein the symbols (a) and (b) in each figure indicate the relative positions between wedges 10, 10' and the base plate 1 and the relative positions between scrapers 8, 8' and the respective parts of the cam plate 7 respectively.

Figure 4:
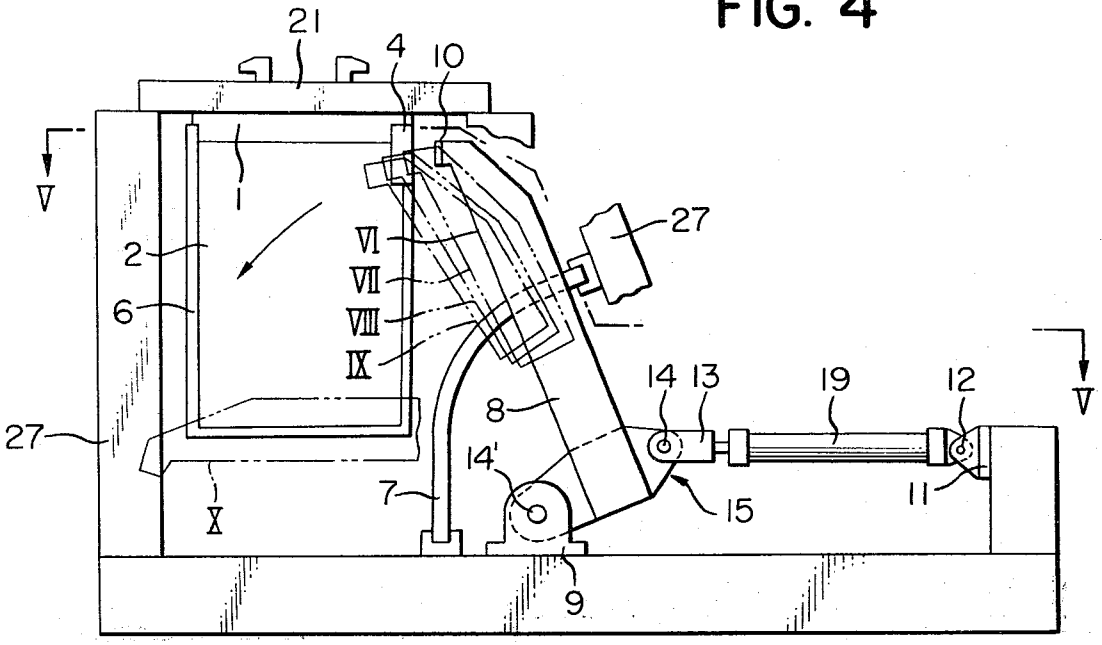
FIG. 4 is a partially cutaway elevational view illustrating the state where the stripping operation is carried out by one embodiment of the stripping apparatus according to this invention.
Figure 5:
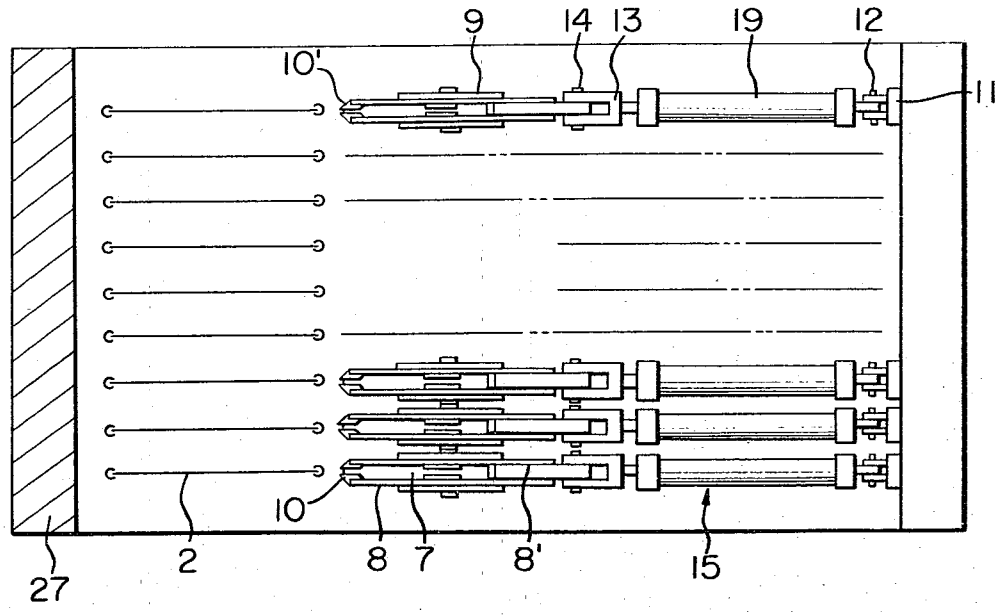
FIG. 5 is a sectional view taken on line V—V of FIG. 4.
Figure 6:
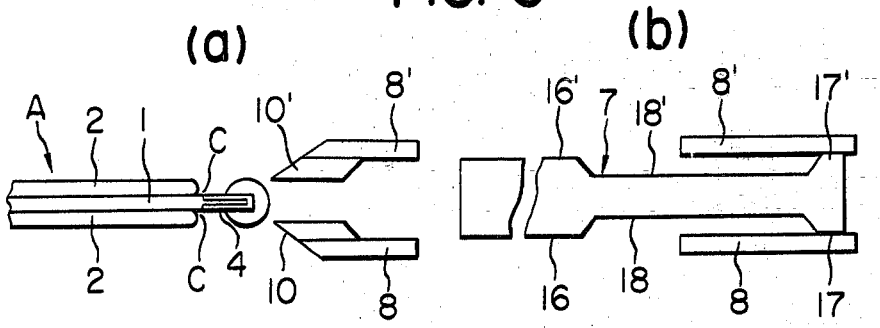
FIGS. 6 to 9 are each a partially enlarged top view illustrating the positional relation between the base plate and the stripping means in the practice of the stripping operation shown in FIG. 4 with reference to positions VI to IX of FIG. 4.

At the time when the base plate 1 has been supported at the predetermined position of the frame 27 as shown in FIG. 4, scrapers 8 and 8' are positioned at VI, wherein scrapers 8 and 8', as shown in FIG. 6(*b*), are spaced from each other by the raised portions 17 and 17' of the cam plate 7 so that the distance between wedges 10 and 10' is greater than the thickness of the base plate 1 and further, scrapers 8 and 8' are located at a position spaced from the insulating material 4.

Figure 7:
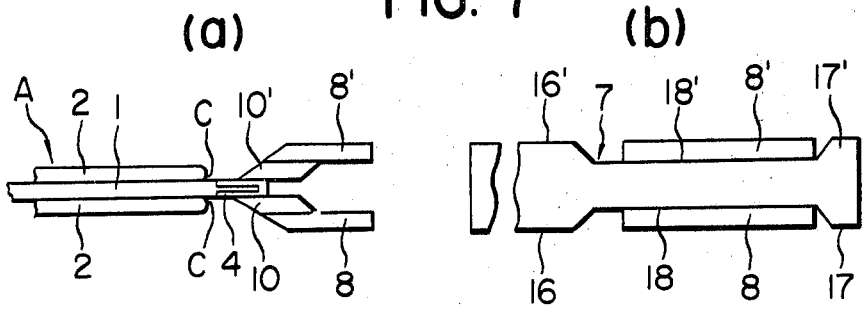

At this time, the cylinder 19 is actuated to move scrapers 8 and 8'. When scrapers 8 and 8' thus reach the position VII in FIG. 4, they move to the depressed parts 18 and 18' of the cam plate 7 as shown in FIG. 7(*b*) and are contracted there by their spring force so that wedges 10 and 10' engage both surfaces of the insulating material 4 of the base plate 1 as shown in FIG. 7(*a*) and slide along said surfaces.

Figure 8:
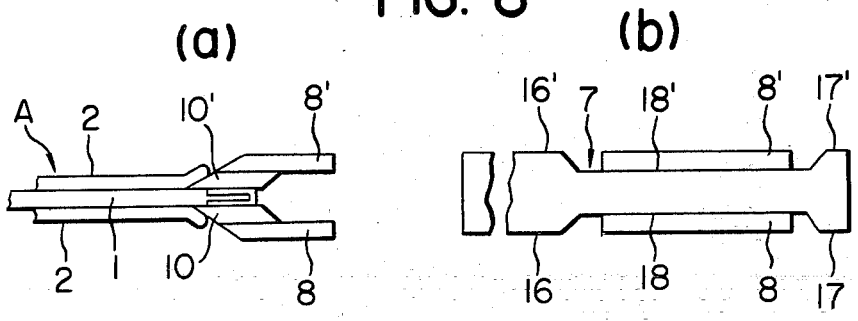

And, when scrapers 8 and 8' reach the position VIII in FIG. 4, wedges 10 and 10', as shown in FIG. 8(*a*), enter the wedge-like gaps C formed on the metal plates 2 and are inserted between said plates 2 and the base plate 1. The stripping operation of the metal plates 2 from the base plate 1 thus begins and this state continues while scrapers 8 and 8' move along the depressed portions 18 and 18' of the cam plate 7 as shown in FIG. 8(*b*).

Figure 9:
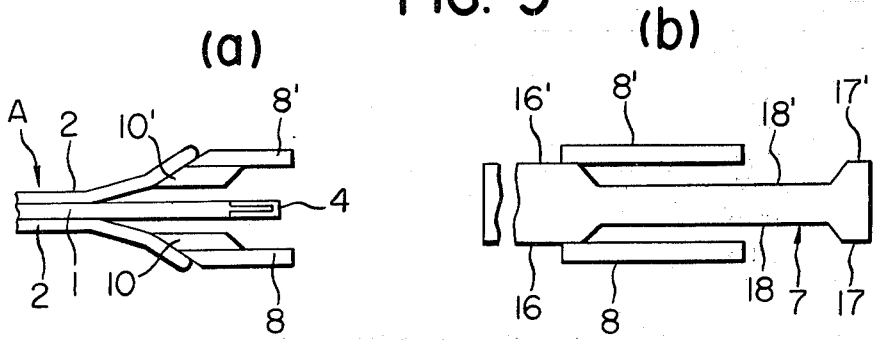

When the stripping operation is carried out by wedges 10 and 10' in the aforesaid state and scrapers 8 and 8' reach substantially the position IX in FIG. 4, scrapers 8 and 8' engage the raised portions 16 and 16' of the cam plate 7 as shown in FIG. 9(*b*) and consequently are moved apart from each other again, whereby wedges 10 and 10' are moved away from both sides of the base plate 1 respectively. The succeeding stripping operation is carried out in this state.

While the aforesaid stripping operation is in progress, wedges 10 and 10' move along a circular arc-like locus with the pin 14' as the center as indicated by the arrow. And, when the wedges arrive at the position X in FIG. 4 the stripping operation is completed.

Second embodiment:

A second embodiment is illustrated in FIGS. 10 to 14 respectively. In this context, it is to be noted that the same symbols will be applied to the parts similar to those in the first embodiment for omitting explanations thereon, and explanation will be made as to the parts different therefrom.

Scrapers 8 and 8' used in this embodiment are made of springs and are normally spaced from each other. Consequently, if there is no force applied to the outside thereof, wedges 10 and 10' will be spaced from the base plate 1.

Cam plates 7 and 7' are located outside of the scrapers 8 and 8' and mounted on a frame 27. Said cam plates are provided at their inside ends with raised portions 16 and 16' and at the rear parts with depressed portions 18 and 18', which is shown in FIGS. 11 to 14.

The stripping operation conducted by using the aforesaid apparatus will be explained mainly with reference to FIGS. 11 to 14.

Figure 10:
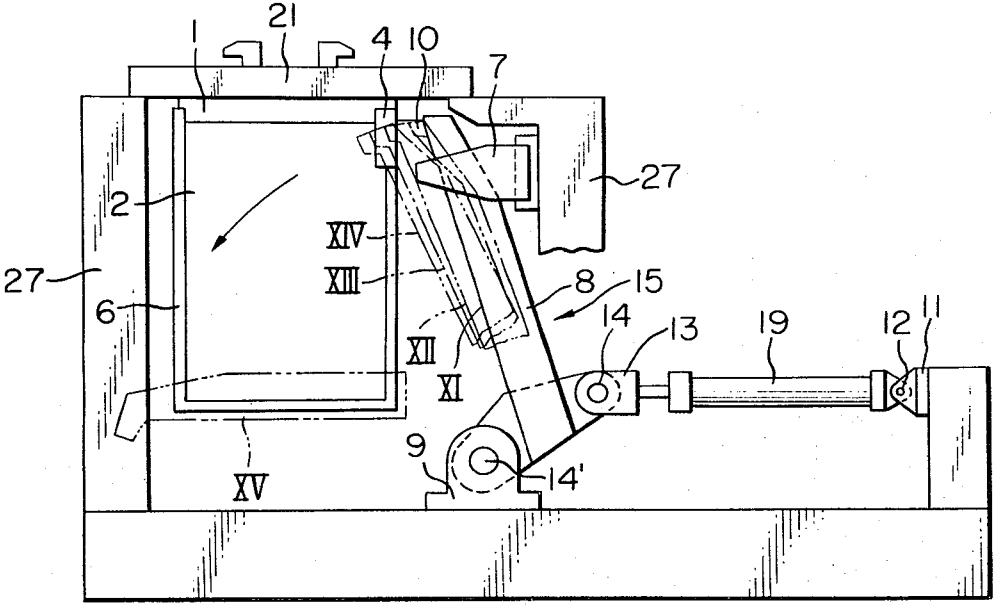
FIG. 10 is a partially cutaway elevational view illustrating the state where the stripping operation is carried out by another embodiment of the stripping apparatus according to this invention.

In FIGS. 11 to 14, the symbols (a) and (b) indicate the relative positions between wedges 10, 10' and the base plate 1 and the relative positions between scrapers 8, 8' and the respective parts of cam plates 7, 7', both being directed toward the cases where scrapers 8 and 8' are located at the positions as shown at XI to XIV of FIG. 10.

Figure 11:
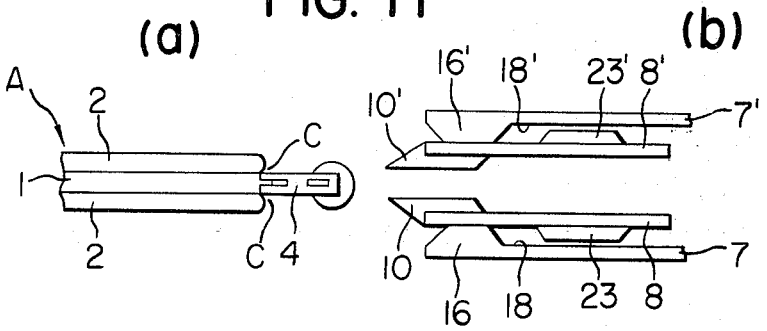
FIGS. 11 to 14 are each a partially enlarged top view illustrating the positional relation between the base plate and the stripping means in the practice of the stripping operation shown in FIG. 10 with reference to positions XI to XIV of FIG. 10.

At the time when the base plate 1 has been supported at the predetermined position of the frame 27 as shown in FIG. 10, scrapers 8 and 8' are positioned at XI, wherein scrapers 8 and 8', as shown in FIG. 11(*b*), are spaced from each other so that the raised portions 23 and 23' thereof face the depressed portions 18 and 18' of the cam plates 7 and 7' and the distance between wedges 10 and 10' is greater than the thickness of the base plate 1, and the wedges are located at a position spaced from the insulating material 4.

Figure 12:
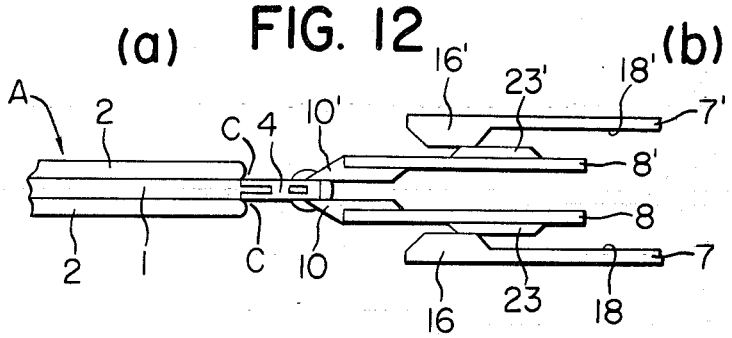

Hereat, the cylinder 19 is actuated to move scrapers 8 and 8'. When scrapers 8 and 8' thus reach the position XII in FIG. 10, the raised portions 23 and 23' of scrapers 8 and 8' move toward the raised portions 16 and 16' of cam plates 7 and 7' as shown in FIG. 12(*b*) and are urged toward each other against the spring force so that wedges 10 and 10' engage both surfaces of the insulating material 4 of the base plate 1 as shown in FIG. 12(*a*) and slide along these surfaces along the metal plates 2.

Figure 13:
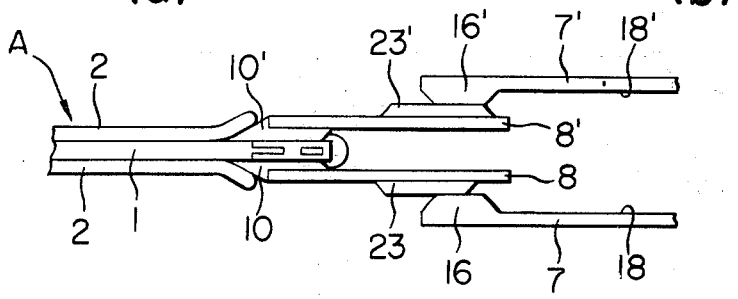

And, when scrapers 8 and 8' arrive at the position XIII in FIG. 10, wedges 10 and 10', as shown in FIG. 13(*a*), are each inserted between the metal plates 2 and the base plate 1. The stripping operation of the metal plates 2 from the base plate 1 thus begins and this state continues while the raised portions 23 and 23' of scrapers 8 and 8' move along the raised portions 16 and 16' of cam plates 7 and 7' as shown in FIG. 13(*b*).

Figure 14:
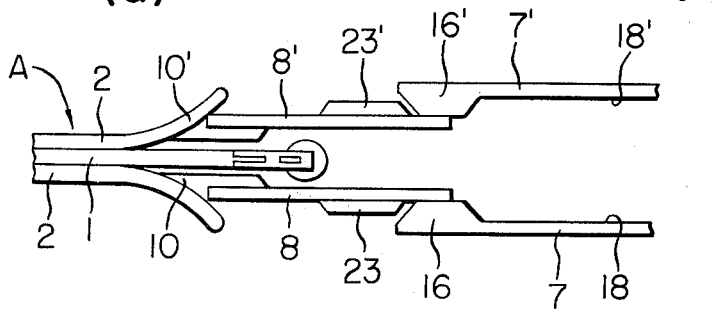

When the stripping operation is carried out by wedges 10 and 10' in the aforesaid state and scrapers 8 and 8' reach substantially the position XIV in FIG. 10, the raised portions 23 and 23' of scrapers 8 and 8' disengage from the raised portions 16 and 16' of cam plates 7 and 7' as shown in FIG. 14(*b*) and scrapers 8 and 8' consequently are spaced from each other again, whereby wedges 10 and 10' are spaced from both surface of the base plate 1 respectively. The successive stripping operation is carried out in this state.

While the aforesaid stripping operation is in progress, wedges 10 and 10' move along the circular arc-like locus with the pin 14' as the center as described in the first embodiment. The stripping operation is completed when the wedges arrive at the position XV in FIG. 10.

Although particular preferred embodiments of the invention have been disclosed hereinabove for purposes of illustration, it will be understood that variations or modifications thereof which lie within the scope of the invention as defined by the appended claims are fully contemplated.

For instance, although a cylinder has been utilized as the working member and a cam has been utilized as the controlling means in aforesaid embodiments, other means, if identical in performance, may be employed in place thereof. Concerning the base plate to be used in this invention, in view of the base plates used in first and second embodiments being enumerated by way of example, another base plate, for instance a base plate lacking the insulating material 4 is employable.

What is claimed is:

1. An apparatus for stripping electrodeposited metal plates from a cathode base plate suitable for electrolytic refining, comprising:

base means;

supporting means mounted on said base means for supporting in an upright position a cathode base plate having electrodeposited metal plates on the opposite surfaces thereof;

a pair of elastically deformable, leaf springs mounted on said base means for movement on opposite sides of said cathode base plate through corresponding arcuate paths from a starting position a starting adjacent the upper corner of one side edge of said cathode base plate across said cathode base plate to a final position adjacent the lower corner of the opposite side edge of said cathode base plate, said leaf springs each having a wedge mounted on one end thereof, said wedges being adapted to engage the opposite surfaces of said cathode base plate and to be moved between said cathode base plate and said electrodeposited metal plates, said wedges being mounted for movement with said leaf springs whereby to strip off said electrodeposited metal plates from said cathode base plate as said leaf springs move from said starting position to said final position;

actuation means for moving said leaf springs through said paths;

controlling means engageable with said leaf springs for elastically deforming same as said leaf springs move through said paths, said controlling means being arranged so that said wedges are positioned in engagement with the opposite surfaces of said cathode base plate and fit between said cathode base plate and said electrodeposited metal plates when said leaf springs are in said starting position and said leaf springs and thereby said wedges move away from each other and away from said cathode base plate whereby to position said wedges out of engagement with the opposite surfaces of said cathode base plate as said leaf springs move across said cathode base plate to said final position.

2. An apparatus as claimed in claim 1 in which said supporting means comprises a beam along the upper edge of the cathode base plate, said beam providing suspending portions at the opposite ends thereof.

3. An apparatus as claimed in claim 1 which said leaf springs have cams engageable with mating cams on said controlling means for moving said leaf springs between mutually adjacent positions wherein said wedges engage the opposite surfaces of said cathode base plate and mutually remote positions wherein said wedges are out of engagement with the opposite surfaces of said cathode base plate.

4. An apparatus as claimed in claim 3 in which said cams on said leaf springs are defined by raised and depressed portions provided on the outer surfaces of said leaf springs.

5. An apparatus as claimed in claim 4 in which said controlling means comprises a pair of stationary cam plates having cams on the opposing inner surfaces thereof, said cam plates being disposed adjacent the outer surfaces of said leaf springs, said cams on said cam plates being engageable with said cams on said leaf springs as said leaf springs are moved through said paths.

6. An apparatus as claimed in claim 3 in which said cams on said leaf springs are defined by planar portions on the inner surfaces of said leaf springs, and said controlling means is a stationary cam plate mounted between the inner surfaces of said leaf springs and having cams on the opposite surfaces thereof, said cams on said stationary cam plate comprising raised portions at the opposite ends thereof and a depressed portion therebetween, said cams on said cam plate being engageable with said cams on said leaf springs as said leaf springs are moved through said paths.

7. An apparatus as claimed in claim 1 in which said leaf springs are moved for pivotal movement and said actuation means comprises a fluid pressure cylinder having a piston rod connected to pivotally move said leaf springs through said paths.

8. An apparatus for stripping electrodeposited metal plating from at least one side of a base plate, comprising:

frame means for supporting said base plate;

a scraper arm arranged generally parallel to said base plate and having a sharpened wedge at one end, and means cooperable with the other end of said scraper arm for movably supporting said scraper arm on said frame means for movement of said wedge along a path of travel extending across the surface of said base plate from a first location to a second location thereon, said scraper arm being resiliently flexible in a direction substantially perpendicular to said base plate and said wedge being movable between positions engaging and spaced from said base plate by flexing said scraper arm, said scraper arm resiliently urging said wedge toward one of said engaging and spaced positions;

means cooperable with said scraper arm for effecting said movement of said wedge along said path of travel; and controlling means cooperable with said scraper arm for flexing said scraper arm and moving said wedge to the other of said engaging and spaced positions during a portion of said path of travel, said wedge being in said engaging position only during a portion of said path of travel which is bounded by said first location and by a third location between said first and second locations.

* * * * *

UNITED STATES PATENT AND TRADEMARK OFFICE

CERTIFICATE OF CORRECTION

PATENT NO. : 4 304 650

DATED : December 8, 1981

INVENTOR(S) : Hiroaki Matsuo et al

It is certified that error appears in the above—identified patent and that said Letters Patent is hereby corrected as shown below:

Please change the title of the invention to ---STRIPPING APPARATUS FOR USE WITH A CATHODE BASE PLATE FOR ELECTROLYTIC REFINING---.

Column 6, line 19; delete "a starting" (last occurrence only).

Column 6, line 54; after "l" insert ---in---.

Signed and Sealed this

*Twenty-third* Day of *March 1982*

[SEAL]

*Attest:*

GERALD J. MOSSINGHOFF

*Attesting Officer*

*Commissioner of Patents and Trademarks*